US005834672A

United States Patent [19]

Wang

[11] Patent Number: 5,834,672

[45] Date of Patent: Nov. 10, 1998

[54] NON-LINEAR TONE GENERATOR

[75] Inventor: Avery L. Wang, Redwood City, Calif.

[73] Assignee: Chromatic Research, Inc., Sunnyvale, Calif.

[21] Appl. No.: 555,536

[22] Filed: Nov. 9, 1995

[51] Int. Cl.[6] ..... G10H 1/00; G10H 1/02

[52] U.S. Cl. ..... 84/660; 84/608; 84/662; 84/665; 84/DIG. 10

[58] Field of Search ..... 84/660, 662, 665, 84/DIG. 10, 608, 477 K, 697, 698, 702, 703, 711, 661, DIG. 9, 659, 607, 663

[56] References Cited

U.S. PATENT DOCUMENTS

| | | | |
|---|---|---|---|
| 4,135,424 | 1/1979 | Okamoto | 84/1.13 |
| 4,249,447 | 2/1981 | Tomisawa | 84/1.01 |
| 4,655,115 | 4/1987 | Nishimoto | 84/1.19 |
| 4,813,326 | 3/1989 | Hirano et al. | 84/1.01 |
| 4,840,099 | 6/1989 | Kitagawa | 84/1.01 |
| 5,042,001 | 8/1991 | Brightman et al. | 364/736 |
| 5,308,918 | 5/1994 | Yamauchi et al. | 84/622 |
| 5,373,098 | 12/1994 | Kitayama et al. | 84/659 |
| 5,432,296 | 7/1995 | Takeuchi et al. | 84/661 |

*Primary Examiner*—William M. Shoop, Jr.
*Assistant Examiner*—Marlon T. Fletcher
*Attorney, Agent, or Firm*—Skjerven, Morrill, MacPherson, Franklin & Friel LLP; Norman R. Klivans

[57] ABSTRACT

A method and apparatus for producing a tone (e.g. for music) without use of a waveform memory and using a feedback loop. The feedback loop includes a waveform generator which calculates, in real time, a parabolic approximation to a sine wave. The feedback loop includes a delay phase differencer to eliminate hunting. The output waveform from the feedback loop is provided to a sine function generator which approximates a sine value using a third order polynomial, to provide the output tone.

25 Claims, 1 Drawing Sheet

Microfiche Appendix Included
(1 Microfiche, 37 Pages)

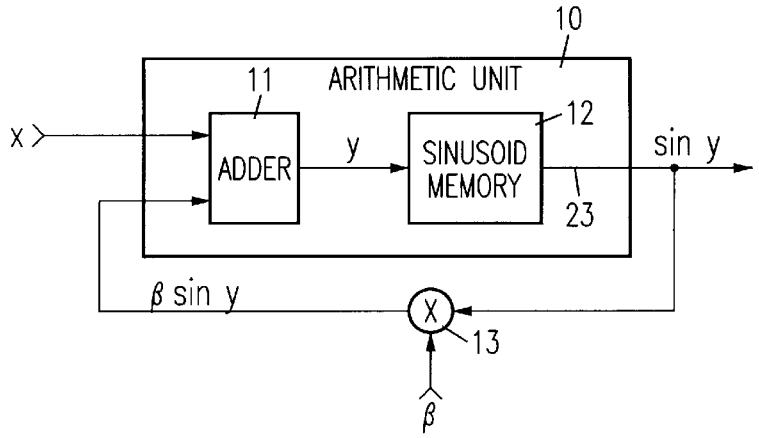
FIG. 1
FIG. 2
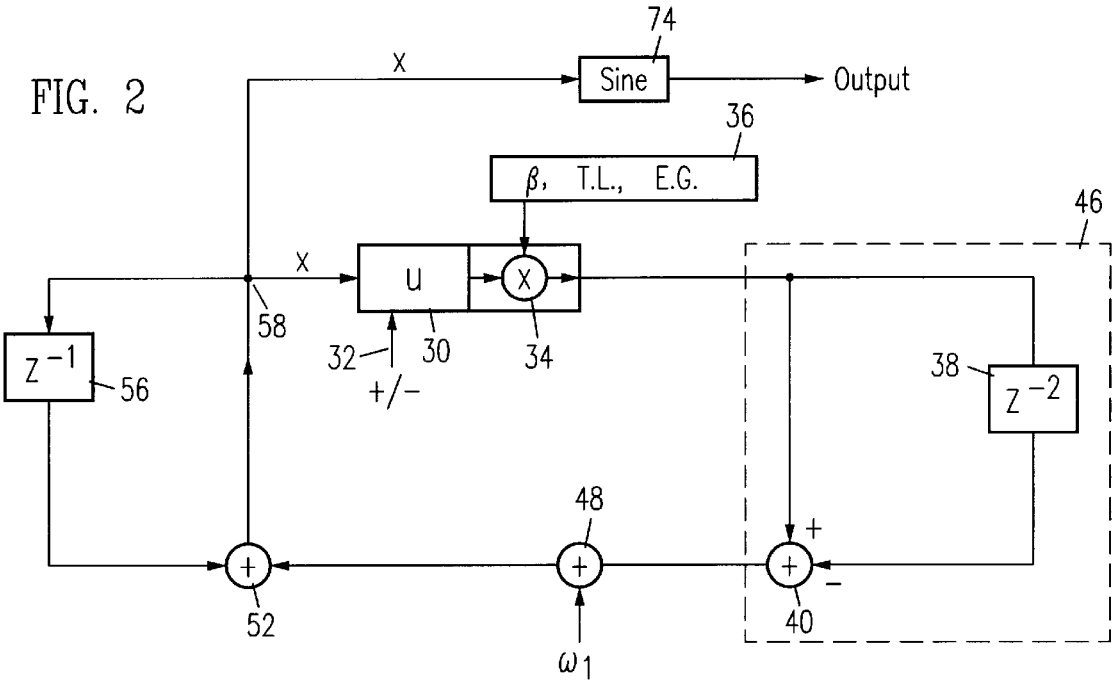
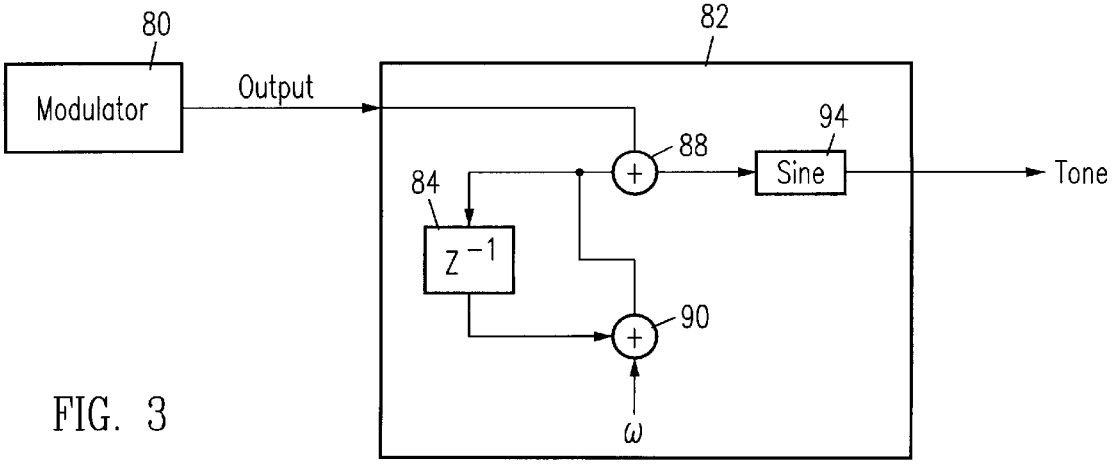
FIG. 3

NON-LINEAR TONE GENERATOR

MICROFICHE APPENDIX

This disclosure includes a Microfiche Appendix having 1 fiche and 37 total frames showing a computer program. This Appendix is subject to copyright protection. The copyright owner has no objection to facsimile reproduction of the patent document and material in Patent Office files, but otherwise reserves all other copyright rights whatsoever.

BACKGROUND OF THE INVENTION

1. Field of the Invention

This invention relates to a method and apparatus for producing tones, for instance for music (sound) synthesis, and more particularly to FM tone generation with dynamically varied spectral brightness and not using a waveform memory.

2. Description of the Prior Art

U.S. Pat. No. 4,249,747 issued Feb. 10, 1981 to Tomisawa and incorporated herein by reference in its entirety describes producing a tone waveform (signal) having a desired spectral construction by modulating an input address signal of a selected frequency for a waveform memory. For the modulation of the input address signal, the output signal of the waveform memory is multiplied by a parameter β of a suitable value and the multiplication product is added to the input address signal.

Tomisawa's FIG. 1 (as shown in present FIG. 1) has an arithmetic unit 10 including an adder 11 and a sinusoidal waveform memory 12 read by an output y of the adder 11. To one input of the adder 11 is applied variable x, and to the other input is applied an output sine y of the sinusoidal wave memory 12 at a suitable feedback ratio. This feedback ratio is determined by a feedback parameter (factor) β. A multiplier 13 in the feedback loop multiplies the output sine y of the memory 12 by the feedback parameter β. Product β·sin y is applied to the adder 11. The output y of the adder 11 therefore is x+β·sin y which constitutes an actual address input of the sinusoidal waveform memory 12. It is assumed that a predetermined delay time exists between application of the input to the adder 11 and delivery of the output from the sinusoidal wave memory 12.

The variable x is generated as shown in Tomisawa FIG. 2 (not included here). The basic input is a particular frequency applied to an accumulator where the frequency number is repeatedly added in accordance with a clock pulse signal. The variable x increases quickly if the frequency number is large and increases slowly if the frequency number is small. The variation rate, i.e. the repetition within the module frequency of the variable x, determines the frequency of a tone produced by the arithmetic unit 10 of FIG. 1.

The tone waveform sine y produced by the arithmetic unit 10 is processed through circuitry shown in Tomisawa FIG. 3 which includes a multiplier, one input of which is sine y and the second input of which is produced by an envelope generator. The envelope generator generates an envelope shaped signal in response to a input signal. This envelope shaped signal is supplied to the multiplier which multiplies the two inputs to produce an output tone.

This approach requires the use of a sinusoid memory 12 as in conventionally used in a music synthesis wherein the elements of a sine wave (i.e., time varying signal) are stored in a memory. By addressing the memory, one accesses the needed corresponding values, thus computing the needed sine wave. Moreover in the structure of FIG. 1, note that the sine y value is multiplied by the parameter β, and supplied back to the sinusoid memory as value y from the adder 11. Thus not only does this require use of a waveform memory, but it also determines the sine value in the feedback loop itself.

A disadvantage of this method is that in some applications memory waveform lookups may incur long latencies, hence degrading performance, or require excessive amounts of system resources in order to provide a tone output in real time. That is to say, the prior art approach is not efficient to implement in a general purpose processor which is relatively slow to perform table lookups.

Also, the system of Tomisawa including the structures of his FIGS. 1, 2 and 3 requires separate processing to apply the β factor and the envelope generator parameter, hence complicating the structure.

Thus it would be desirable to improve upon the system of Tomisawa, both in terms of performance (speed) and method of operation.

SUMMARY

The present invention is directed to the field of frequency modulation sound synthesis which is usually considered to be using combinations of higher harmonics created by modulation. This allows one to generate waveforms including both the higher harmonics and non-harmonic sounds, and allows production of a wide range of sounds including those which sound similar to those produced by actual physical instruments as well as more synthetic sounding sounds.

In accordance with the present invention, an FM (frequency modulation) tone is produced using a feedback method. However, no sinusoidal memory (or other type of lookup) is used to generate the feedback signal; instead the signal is generated by a calculation based on an externally supplied parameter. This advantageously speeds up the operation, especially considering that current trends in computer architectures are that computational bandwidth is increasing faster than memory system bandwidth, tilting the balance towards direct computation over memory access for calculating function values. In the present case the calculation is a series of relatively simple multiplications and additions which are performed quickly. Another advantage of the present approach is that the prior art tables consumed significant amounts of chip real estate for the required ROM; this is not needed with the present approach, thus economizing on chip real estate and hence reducing chip cost. Additionally, instead of using the single spectral brightness feedback factor β, three parameters are combined into one including the spectral brightness, total level, and envelope parameters, and this single parameter is applied to the calculated initial waveform which is then fedback.

The present feedback loop eliminates the so-called "hunting" phenomenon (identified by Tomisawa at col. 8, lines 60–68) by means of delayed phase differencing, as opposed to Tomisawa's averaging approach.

Additionally, while a sine function generator is included in one embodiment of the present tone generator, this sine function generator is not a sine lookup table and additionally is not a part of the feedback loop, unlike that of Tomisawa. Instead, in accordance with the present invention an output of the feedback process is applied to a sine function generator. The sine function, instead of being looked up, is calculated by means of an approximation, in one embodiment using Horner's rule which approximates a sine value as a third order polynomial.

Additionally, the spectral brightness parameter, rather than being the static value disclosed by Tomisawa, here is a time varying dynamic value for improved spectral brightness.

Further, in accordance with this invention, the present feedback loop may be used as a modulation generator without the sine function generator or any other function generator, for instance to drive an oscillator.

An apparatus in accordance with the present invention may be implemented by either computer software executed by a processor or by dedicated circuitry, both of the type well known in the art. While the present disclosure is directed to a software embodiment, it is to be understood that the present invention may be implemented by circuitry and the implementation in such circuitry is well within the skill of one of ordinary skill in the art given in the present disclosure.

BRIEF DESCRIPTION OF THE DRAWINGS

FIG. 1 shows a prior art tone generator method using a sinusoid memory.

FIG. 2 shows a tone generator in accordance with the present invention.

FIG. 3 shows the tone generator of FIG. 2 driving a carrier oscillator.

DETAILED DESCRIPTION

FIG. 2 shows in diagrammatic form an apparatus and associated method in accordance with the present invention; this is illustrative and not limiting. The actual implementation would be e.g. in computer software executed by a processor, or a dedicated circuit (or a combination of both) in accordance with FIG. 2. FIG. 2 uses a number of conventions to illustrate sound synthesis.

Beginning (arbitrarily) at function U (reference number 30), function U calculates values defining a parabola using the well known formula $x^2-1$, where x is a value at node 58 which is input to the function U. The calculated output from function U, which is a parabolic waveform, is supplied as one input value to a multiplier 34. A second (control) input to function U 30 is a plus/minus (±) sign indicator 32. The purpose of indicator 32 is to indicate that the parabola is facing up (cup shaped) or facing down (hill shaped). Rather than generating two parabolas, only one parabola is generated and then a sign (±) is applied to the output value thereby providing both upward and downward facing parabolic segments.

These parabolic segments approximate a sine curve, using the simple $x^2-1$ calculation. It is to be understood that while a parabola is not the same as a sine curve, it roughly approximates a segment (lobe) of a sine curve. Hence one can approximate a continuous sine curve by a series of linked parabolic segments alternately facing up and facing down (plus or minus in sign). Thus the present feedback loop, rather than including any sine calculation or memory lookup table, instead generates by calculation a series of linked parabolic segments.

The parabola is generated by function U 30 as follows, using e.g. conventional computer software steps:

1. The value x is a value in the range −1 to 1, expressed as a binary multi-bit value where the first bit is a sign (+ or −) bit.

2. The most significant (sign) bit is stripped off, thus in effect multiplying x by two by a left shift step.

3. The remaining most, significant bit is inverted (0 becomes 1 and vice versa), resulting in a value x' from which the parabola $y=(x')^2-1$ is calculated.

Multiplier 34 (of the type conventional in the art) multiplies the parabolic waveform output by function U by a feedback factor, which in this case is the product of three parameters: (1) the well known β parameter of the type described by Tomisawa, which is an indicator or spectral brightness, (2) a total level factor (T.L.), and (3) an envelope generator factor (E.G.).

Use of these three parameters to form the feedback parameter is not limiting but is for one particular embodiment of the present invention, which is compatible with the well known Yamaha YM3812 chip, also called the OPLII. The total level (T.L.) and envelope generator factors (the envelope generator including the attack rate/decay rate and the sustain level/release rate) are values provided to this chip for determining the output waveform. See Yamaha document LSI-2438120 published June, 1987 entitled "YM3812 Application Manual" at page 8 showing an address map for registers for storage of values describing the total level and the attack rate/decay rate and sustain level/release rate. While the multiplicative feedback factor of block 36 in accordance with the present invention has a somewhat similar function as does the β factor in Tomisawa, the present feedback factor as described below is arrived at differently than in Tomisawa and includes additional elements.

Multiplier 34 outputs a waveform (signal) which is provided both as an input signal to the double delay element 38 and as a first input signal to the adder 40. Double delay element 38 (designated by $Z^{-2}$) is for instance two single delay elements connected in series. Each delay is for one sample period; use of such single delay elements is well known in the art.

The output signal of the double delay element 38 is coupled to the negative input terminal of adder 40. The elements inside dotted line 46 are a phase differencer which applies the double delay to the signal which passes through the delay element 38 and then combines the delayed signal with the original signal (which has not been delayed). This phase differencer 46 overcomes the hunting phenomenon described by Tomisawa at column 8 beginning at line 60. Tomisawa discloses an averaging device shown in his FIG. 8, intended to overcome hunting. This includes a delay flip flop providing a single delay and an adder adding the output of the delay to the original signal and a multiplier which multiplies the output of the adder by ½.

The present inventor has found that another approach providing the double delay (two time units delay) also eliminates hunting. Moreover the location of the phase differencer 46 in FIG. 2 is different than that disclosed by Tomisawa which is described as being "on the output side of the sinusoidal wave memory 12".

With regard to the phase differencer 46, while this outputs an average signal, the actual averaging, i.e. the required division by two, is not performed in block 46 but instead is incorporated into the envelope generator parameter (E.G.) in block 36 for convenience. It can be seen that phase differencer 46 takes a first signal U(n)-U(n−1) and adds it to the preceding signal U(n−1)-U(n−2) due to the inverting nature of the second input terminal of adder 40. (The numbers in the parenthesis refer to clock cycles.) Thus the sum of the these two signal values is U(n)-U(n−2), which is a time difference (delay) of 2. This value is then effectively divided by 2 (as described above, as incorporated into feedback factor block 36) to provide the desired phase difference averaging and thus eliminate hunting.

In accordance with the invention, the value of the feedback factor of block 36 is a non-static value varying with time. This has been found to provide a time varying timbre.

The output signal from the adder 40 is coupled to a second adder 48, the other input of which is a base frequency $\omega_1$, which is constant for each particular note.

Base frequency ω1 is e.g. calculated from the Lo, Hi, and Block variables defining a note as described in the above-referenced Yamaha document. It is to be understood that the base frequency is determined conventionally for instance by a user or by a computer program for determining the output signal for a particular note. Thus the base frequency is characteristic of each individual note.

Referring back to FIG. 2, the sum output by the adder 48 is a first input signal to an adder 52. The other input to adder 52 is the signal at node 58 delayed by one time unit by delay ($Z^{-1}$) element 56.

The output signal x is applied as an input signal to a sine function generator 74. Thus the value sine x is the output signal. This output signal can be a tone (direct output), or an input to a carrier oscillator. FIG. 3 shows this second case where a modulator 80 (of the type shown in FIG. 2) drives a conventional carrier oscillator 82 which includes a delay element 84, adders 88, 90, and sine function generator 94, to produce an output tone.

In another embodiment, instead of a sine function generator, some other functional approximation is used, or alternatively no function is applied and the signal X is used directly as the output of the modulation generator of FIG. 2.

In the prior art, sine values are typically determined by a lookup table. A lookup table has a large number of addressable entries, each entry including a sine value for that address. Such lookup tables are usually implemented in read only memory. However in many modern computer systems, the time required to look up values in such a table is excessive and hence degrades system performance. Another disadvantage of table-based sine (or function) lookups is that the values are exact only when the input argument value exactly matches one of the points at which the function was sampled. Typically, the table is addressed by using only the most significant bits of the argument value as the memory address bits and throwing away the least significant bits of the argument. This results in a "sawtooth" error in the lookup approximation that changes periodically as the argument value increases. Such artifacts greatly reduce the number of bits of precision and may result in audible artifacts in a musical tone generator. A polynomial approximation, on the other hand, smoothly calculates the output value using all the available bits, resulting in many more bits of precision.

That is, it has been found by the present inventor that it is faster to calculate sine values than to look them up, using a fast approximation on a digital signal processing chip having parallel functional units. See co-pending and commonly owned U.S. patent application Ser. No. 08/541,565, filed Oct. 10, 1995, inventors James T. Battle, Andy C. Hung, and Stephen C. Purcell, entitled "Multi-Media Engine Including Processor Using Variable Length Instructions" incorporated herein by reference in its entirety. A processor as described in that disclosure allows calculation of for instance four or more individual calculations simultaneously. This has been found to be faster than using a lookup table.

The sine value may be calculated by sine generator 74 in a number of well known ways. However while such calculations are available and may be used in accordance with the present invention, the present inventor has discovered an exceptionally fast and accurate method of approximating a sine value. Thus in one embodiment of the present invention, a successive approximation is used to calculate the sine value using only a third order polynomial, providing an approximate value accurate to 16 bits. This of course conserves processor resources. Also, in one implementation only eighteen data bits are available to calculate and to express the output sine value. This is due to system limitations imposed by use of a 72 bit wide processor data path which is split up into e.g. 4 individual 18 bit data paths, for simultaneous calculation of sine values for maximum speed. The sine value is approximated to 16 bit precision using the well known Horner's rule for calculating a polynomial value.

Horner's rule for calculation of a third degree polynomial is:

$$P(y)=\alpha_0 y^3+\alpha_1 y^2+\alpha_2 y+\alpha_3$$

Let $$P_1(y)=\alpha_0 y+\alpha_1$$

$$P_2(y)=P_1(y)y+\alpha_2=\alpha_0 y^2+\alpha_1 y+\alpha_2$$

$$P_3(y)=P_2(y)y+\alpha_3=\alpha_0 y^3+\alpha_1 y^2+\alpha_2 y+\alpha_3$$

then $$P(y)=P_3(y)$$

And $$y=x^2-1$$

The implementation in either circuitry or by computer software will be apparent to one skilled in the art in light of this explanation.

This approximation uses a third order polynomial in y, i.e. $y^3$, $y^2$, y and four coefficients $\alpha_0$, $\alpha_1$, $\alpha_2$, $\alpha_3$ where sine $x=\alpha_0 y^3+\alpha_1 y_2+\alpha_2 y+\alpha_3$, and where $y=x_2-1$, with relation to FIG. 2. Such a calculation in software can be carried out efficiently by a series of "op codes" (operations) where each operation is a multiply and add ("MAD") operation. Four such MAD operations are used. The first computes $y=x^2-1$. The second computes $\alpha_0 y+\alpha_1$. The third multiplies this value by y and then adds $\alpha_2$, and the fourth multiplies this value by y and then adds $\alpha_3$. This yields a close approximation to the desired sine value. The coefficients $\alpha_0$, $\alpha_1$, $\alpha_2$, $\alpha_3$ are derived from a least squares fit to a single lobe of a sine curve and shown in the Microfiche Appendix at the table labelled "sine coefs". These coefficients typically are fixed for any one implementation.

As described above, one embodiment of the present invention is in the form of a computer program (software) for sound (music) synthesis. An example of such a computer program is shown in the Microfiche Appendix which is part of the disclosure. This program is in an assembly language and with comments for understanding. It includes as a first main element the process (module) designated sb_fm_tick.x. The following discussion is only of portions of this process as they pertain to the above discussion; a substantial part of the computer program is "overhead" code for handling the data and for set up and output purposes. Also, this program includes full FM music synthesis capabilities including other aspects not described herein. This program is compatible at the register level with the Yamaha OPLII chip. Of course, this is not limiting to the present invention.

With reference to the computer program and especially the first process sb_fm_tick.x, the feedback loop of FIG. 2 is embodied in the code beginning at the comment "SB-FM Loop".

The code relating to the envelope generation, i.e. block 36 of FIG. 2, begins on the same page with the comment "Compute Envelopes". The delay lines 38, 56 and 62 of FIG. 2 are embodied in the code beginning with the comment two pages later labelled "update delay line".

The above described computation of the value x' is performed by the code beginning with the comment "Phases done: do wave select".

The sine function calculation in block 74 of FIG. 2 is carried out by the code immediately following beginning with the comment "calculate sines". The Horner's rule calculation follows immediately thereafter, the polynomial coefficients being labelled sine_coef. In this case only three coefficients are used because the last coefficient $\alpha_3$ is equal to zero.

The following portion of code beginning with the comment "Sum Over Oscillators" combines the outputs of up to 20 oscillators, thus supporting polyphonic music synthesis.

Another process (module) of this program entitled "sb_fm_msgs.x" is "message" code to handle messages (data/address inputs) from the "audio process manager" designated XAPM which is a portion of a related computer program for sound synthesis; this relates to the shell/operating system as described in the commonly owned patent application invented by Avery L. Wang and entitled "A System and Method for Stack Based Processing of Multiple Realtime Audio Tasks" filed Nov. 9, 1995, Ser. No. 08/556,420 and the commonly owned patent application invented by Denis Gulsen and entitled "A System for Fast Context Switching Between Tasks In Real-Time Operating Systems", filed Nov. 9, 1995, Ser. No. 08/556,416, now U.S. Pat. No. 5,727,211 issued on Mar. 10, 1998. Note that a "tick" refers to a group. (e.g. 64) of sound samples. Each message includes an address and the associated data which is loaded into appropriate registers, which emulate the OPLII registers as described in the Yamaha YM3812 application manual document referred to above. This process is not described in detail herein as being further described in the later two above-referenced patent disclosures.

The process in the Microfiche Appendix entitled sb_fm.h defines the data structures and register maps used by the tone generating algorithm.

This disclosure is illustrated and not limiting; further modifications will be apparent to one of ordinary skill in the art in light of this disclosure and are intended to fall within the scope of the appended claims.

I claim:

1. A method for producing a tone, comprising the steps of:

generating a signal by a calculation;

multiplying the generated signal by a feedback parameter to produce a product signal;

providing a base frequency; and feeding back a sum of the base frequency and the product signal as an input value to the step of generating.

2. The method of claim 1, wherein the step of generating comprises the steps of:

providing an input value;

calculating a parabolic waveform segment as a function of a square of the provided input value; and linking a series of parabolic waveform segments that are alternately plus or minus in sign.

3. The method of claim 1, wherein the step of feeding back includes the steps of:

delaying the product signal by at least two time increments; and combining the delayed product signal with the product signal, thereby overcoming hunting.

4. The method of claim 1, wherein the step of feeding back further comprises accumulating the sum of the base frequency and the product signal.

5. The method of claim 1, further comprising the steps of:

providing a spectral brightness parameter, a total level parameter, and an envelope parameter, and wherein the step of multiplying includes multiplying the generated signal by a product of the spectral brightness, total level, and envelope parameters prior to the step of feeding back.

6. The method of claim 5, wherein the spectral brightness parameter is a time-varying parameter, thereby allowing a time-varying timbre to the tone.

7. The method of claim 5, wherein the spectral brightness, total level, and envelope parameters are first multiplied together to form the feedback parameter which is then multiplied by the generated signal.

8. The method of claim 1, further comprising the step of (approximating) calculating a waveform from the product signal; wherein the calculated waveform is not fed back to the step of generating.

9. The method of claim 8, wherein the step of calculating includes approximating a sine value.

10. The method of claim 9, wherein the step of approximating a sine value comprises the step of calculating the sine value using an approximation function.

11. The method of claim 10, wherein the step of calculating includes the steps of:

providing a set of coefficients; and calculating the sine value by use of no higher than a third order polynomial using the set of coefficients.

12. The method of claim 9, wherein the step of calculating uses a multiplication operation no more than four times, to approximate the sine value using no higher than a third order polynomial.

13. An apparatus for producing a tone, comprising:

a waveform generator producing a signal by a calculation;

a multiplier receiving the signal from the waveform generator and a feedback parameter and producing a product signal therefrom;

an adder connected to the multiplier and to a source of a base frequency for adding the product signal and the base frequency; and a feedback loop coupling a sum output by the adder to an input of the waveform generator.

14. The apparatus of claim 13, wherein the waveform generator calculates a parabolic signal from a square of the input to the waveform generator, and links a series of parabolic signals that are alternately plus or minus in sign.

15. The apparatus of claim 13, wherein the feedback loop includes a double delay; and further comprising a second adder connected to combine the double delayed product signal with the signal from the waveform generator, and feeding back the resulting combined value.

16. The apparatus of claim 13, wherein the feedback loop includes a second adder connected to receive the sum of the base frequency and the product signal, for accumulating the sum of the base frequency and the product signal.

17. The apparatus of claim 13, further comprising means for combining a spectral brightness parameter, a total level parameter, and an envelope parameter to form the feedback parameter.

18. The apparatus of claim 17, further comprising means for time varying the spectral brightness parameter.

19. The apparatus of claim 17, wherein the means for combining multiplies the spectral brightness parameter, total level parameter, and envelope parameter together.

20. The apparatus of claim 13, further comprising a function generator having an input terminal connected to the feedback loop and being outside the feedback loop and providing at its output terminal the tone.

21. The apparatus of claim 20, wherein the function generator is a sine function generator connected outside the feedback loop.

22. The apparatus of claim 21, wherein the sine function generator includes:

means for providing a set of coefficients; and means for calculating an approximated sine value using no higher than a third order polynomial using the coefficients.

23. The apparatus of claim 22, wherein the means for calculating uses a multiplication operation no more than four times to approximate the sine value using the third order polynomial.

24. A method for producing a tone by synthesizing a waveform using a polynomial of a variable x, comprising the steps of:

providing a set of at least three coefficients $\alpha_0$, $\alpha_1$, $\alpha_2$,;

calculating an approximation of a sine value of the variable x using a polynomial of the variable x by the steps of:

providing a value of the variable x;

computing by a first operation a value y that is a sum of $x^2$ and a constant;

performing no more than three more operations a, b, c to compute respectively:

(a) $\alpha_0 y+\alpha 1$;

(b) $y(\alpha_0 y+\alpha_1)+\alpha_2$; and (c) $y(y(\alpha_0 y+\alpha_1)+\alpha_2)$; and generating a tone from the result of operation (c) using the calculated approximation of the sine value of the variable x using a multiply operation no more than four times.

25. The method of claim 24, further comprising the step of deriving the coefficients $\alpha_0$, $\alpha_1$, $\alpha_2$ from a least squares fit to a sine curve.

* * * * *